US010472773B2

(12) United States Patent
Beutler

(10) Patent No.: US 10,472,773 B2
(45) Date of Patent: Nov. 12, 2019

(54) TRANSPORT SYSTEM WITH AN ENGAGEMENT MEMBER MOUNTED TO A RAIL

(71) Applicant: Jörg Beutler, Holzkirchen (DE)

(72) Inventor: Jörg Beutler, Holzkirchen (DE)

( * ) Notice: Subject to any disclaimer, the term of this patent is extended or adjusted under 35 U.S.C. 154(b) by 250 days.

(21) Appl. No.: 15/498,922

(22) Filed: Apr. 27, 2017

(65) Prior Publication Data

US 2017/0314209 A1 Nov. 2, 2017

(30) Foreign Application Priority Data

Apr. 29, 2016 (EP) ..... 16167715

(51) Int. Cl.
*E01B 25/04* (2006.01)
*B61B 13/02* (2006.01)
*B61B 5/02* (2006.01)

(52) U.S. Cl.
CPC ..... *E01B 25/04* (2013.01); *B61B 5/02* (2013.01); *B61B 13/02* (2013.01)

(58) Field of Classification Search
CPC ..... B61B 5/00; B61B 10/00; B61B 10/04; B61B 12/00; B61B 19/20
See application file for complete search history.

(56) References Cited

U.S. PATENT DOCUMENTS 4,353,308 A 10/1982 Brown
8,661,987 B2 * 3/2014 Urich ..... B61B 13/02 104/118

FOREIGN PATENT DOCUMENTS

| | | | |
|---|---|---|---|
| AT | 413091 | B | 11/2005 |
| CH | 669807 | A5 | 4/1989 |
| DE | 2552544 | A1 | 6/1977 |
| EP | 2483121 | A1 | 8/2012 |
| EP | 2483121 | B1 | 1/2017 |
| WO | 2011/039335 | A1 | 4/2011 |

OTHER PUBLICATIONS

Nov. 11, 2016, Extended European Search Report from the European Patent Office in European Patent Application No. 16167715.8-1754, which this U.S. application claims the benefit of priority.

* cited by examiner

*Primary Examiner* — Robert J McCarry, Jr.
(74) *Attorney, Agent, or Firm* — Kolitch Romano LLP

(57) ABSTRACT

An embodiment of a transport system may include a vehicle and a circuit with a rail extending at least on sections of the circuit. The system may include a drive system configured for a positive drive for propelling the vehicle along the circuit, wherein, at least on sections extending along the circuit, the drive system has first and second engagement members. The first engagement member may have a first projection and an adjacent second projection on at least sections of the circuit and, between the first and adjacent second projections, grooves, which are each bounded by the first and adjacent second projections. The first engagement member may have one or more openings, of which at least one through-opening is formed between the first and adjacent second projections. Through the through-opening may engage a connecting member configured for connecting the first engagement member with the rail for attachment to the rail.

19 Claims, 6 Drawing Sheets

TRANSPORT SYSTEM WITH AN ENGAGEMENT MEMBER MOUNTED TO A RAIL

CROSS-REFERENCE TO RELATED APPLICATION

This application claims priority to European Patent Application No. 16167715.8, filed Apr. 29, 2016, which is hereby incorporated by reference.

BACKGROUND

Transport vehicles with positive drives are known, for example, cog railways and in the mining industry. Positive drives have an advantage over friction drives in that the efficiency can be improved because the drive wheel in the case of a positive connection cannot slip on the drive rail. In addition, greater torques and thus greater acceleration can be transferred from the drive to the rail.

These drives have already been proposed for use in roller coasters, too. However, there is the problem that the rack limits the possibilities for the realization of certain routes. As amusement rides are intended to thrill users by traversing the most spectacular possible thrill elements, a complicated route with more or less steep rises (e.g., camel back), curves, twists (e.g., screw), and also combinations of these (e.g., cork screw), must be realized in many cases. However, since the racks, as well as the guide elements (rails), are not freely bendable and twistable, there is limited scope for designing the circuit.

EP 2483121 A1 discloses the attaching of a rack between the pipes arranged one above the other of a monorail or at one of the pipes of a monorail. However, difficulties arise when conventional components and methods are used for attaching an engagement member for the gear wheel of the drive of the vehicle to a rail, especially in the case of curved and complex track routes with twisting of the track.

SUMMARY

One or more of the embodiments of the present invention relates to a transport system comprising: a vehicle; a circuit with a rail extending at least on sections of the circuit along which the vehicle is movably disposed; and a drive system for a positive drive for propelling the vehicle along the circuit, wherein, at least on sections extending along the circuit, the drive system has a first engagement member and a second engagement member, which is connected to the vehicle and which is propellable.

An object of one or more embodiments of the present invention is to propose a transport system with a positive drive system in which an engagement member for a gear wheel of a gear drive on the vehicle side can be simply and reliably mounted to a rail extending along the circuit, even in the case of complex track routes.

According to one or more embodiments of the present invention, a transport system comprises: a vehicle; a circuit with a rail extending at least on sections of the circuit along which the vehicle is movably disposed; and a drive system for a positive drive for propelling the vehicle along the circuit, wherein, at least on sections extending along the circuit, the drive system has a first engagement member and a second engagement member, which is connected to the vehicle and which is propellable. The first engagement member has projections on at least sections of the circuit and, between the projections, grooves (engagement grooves for the second engagement member), which are each bounded by a first projection and an adjacent second projection, wherein the first engagement member has openings (i.e., through holes, through openings or passageways), of which at least one opening is formed between the first projection and the adjacent second projection, through which said opening engages a connecting member for the purpose of connecting the first engagement member with the rail for the purpose of attachment to the rail. The opening has an opening cross-section which is located between the projections on the engagement side and is disposed so as to be accessible. That is, at the moment of an engagement of an engagement projection of the second engagement member with the first engagement member, the engagement-side opening cross-section lies in the region below or adjacent to a complementary engagement projection of the second engagement member. The cross-sections or diameters of the opening are adapted such that the connecting member or a shaft of the connecting member can be guided through.

In one or more embodiments of the present invention, the opening has a rail-side opening cross-section, through which the opening of the first engagement member opens snugly into a corresponding bore or opening formed in the rail.

In one or more embodiments of the present invention, practically every positive engagement requires complementary first and second engagement members, wherein the first engagement member disposed along the circuit has, as a rule, projections protruding at periodic distances and grooves between them, into which corresponding projections/grooves of the second vehicle-side engagement member can engage. Projections within the meaning of one or more embodiments of the present invention are all components which protrude perpendicularly or transversely to the direction of travel and which allow an engagement for the purpose of force transmission from the vehicle to the rail (and vice versa) for the purpose of accelerating/propelling the vehicle along the circuit.

In one or more embodiments of the present invention, the projections extend from a base of the first engagement member along the engagement plane (this generally forms a plane of symmetry) transversely to the direction in which the first engagement member extends.

In one or more embodiments of the present invention, especially along sections of the circuit, the first engagement member has teeth, and grooves (tooth gaps) between the teeth, which are each bounded by a first tooth flank and a second tooth flank, wherein the first engagement member has openings, of which at least one opening (e.g., through hole) is formed between one of the first tooth flanks and an adjacent second tooth flank, through which said opening engages a connecting member for the purpose of connecting the first engagement member with the rail for the purpose of attachment to the rail.

In one or more embodiments of the present invention, however, the first engagement member can also be designed, e.g., as a cage gear, lantern pinion rack or similar. In this case, the projections of the toothing are (possibly rotatably mounted) bolts or cylinders, each of which bounds an interposed engagement gap (groove) through which the through-opening extends for access of a connecting member.

In one or more embodiments of the present invention, the term "tooth gap" can be used synonymously with the term "groove between the projections", e.g., for the region between two bolts of a cage rack or lantern pinion rack.

In one or more embodiments of the present invention, the rail can be a holding rail merely for attaching the first engagement member. However, at the same time, it can also be a rail which guides the vehicle, i.e., a guide rail. The rail is an elongated component with an outer contour of generally circular cross-section, e.g., a pipe with a circular external cross-section. However, it can also have cross-sections which deviate therefrom, e.g., an oval, rectangular, polygonal or square cross-section.

In one or more embodiments of the present invention, between two teeth of the toothing in the first engagement member is provided a through-opening. Insofar as the toothing includes chain links, the through-openings or at least the opening cross-section on the engagement side can be disposed, e.g., between two adjacent identical chain links. A screw or bolt passes through the through-opening into which the opening opens, i.e., the connecting members are pushed into and through the openings and are attached to the rail, e.g., by way of screwing.

In one or more embodiments of the present invention, in this way, time-saving assembly, combined with variable attachment of a rack, especially a flexible rack (chain), to a pipe or similar is made possible.

In one or more embodiments of the present invention, pipes and a flexible rack can be bent and/or twisted three-dimensionally with sufficient accuracy. If a guide rail includes a pipe, it would seem to be the thing to do to mount the flexible rack direct to the pipe as it thereby is guided in space and at the same time, in statics terms, sufficiently strong attachment to the rail is enabled in order that the driving force may be transmitted from the drive wheel to the support structure via the rack. In addition, provision must be made for an additional attachment of the rack to the rail, said attachment having the exact same curvature and the same strong design in statics terms.

With the aid of one or more embodiments of the present invention, assembly is made possible, although as a rule little space is available on the rail, as the lanes for the running and supporting wheels may also be located on the travel pipe. Welding on of the first engagement member would require, e.g., more space on account of weld seams about the rack. Moreover, within the scope of one or more embodiments of the present invention, large forces can be transmitted reliably to the rail.

In one or more embodiments of the present invention, in the case of a positive drive, it is also necessary to position the first engagement member (of the circuit) exactly with respect to the second engagement member (of the vehicle). Exact positioning with respect to the guide wheels of the vehicle (which determine the position of the second drivable engagement member) is also especially necessary.

Exact positioning may require on-site assembly, for which purpose welding is unsuitable, whereas screwing is readily possible even at the site where the transport system is constructed.

In one or more embodiments of the present invention, the basis of any positive drive, such as where high speeds are envisaged for transport systems, especially for amusement rides/roller coasters, is the most accurate possible arrangement of the toothed partners relative to one another, which is achieved by the present invention. Moreover, the necessary accuracy can also be maintained in complex circuits (e.g., three-dimensional twists). For other transport systems, too, e.g., systems for, e.g., transporting materials, rails with narrow radii and also twists (e.g., to tilt the vehicle in horizontal curves for the purpose of reducing transverse forces or for enabling higher speeds in curves) are advantageous.

In one or more embodiments of the present invention, the first engagement member is attached to at least sections of the rail by way of positive-locking connecting members.

In one or more embodiments of the present invention, the first engagement member can be attached to at least sections of the rail by way of friction-locking connecting members.

In one or more embodiments of the present invention, the cross-section of the rail is configured to have a convex outer surface. The cross-section can especially be circular, annular or tubular.

In one or more embodiments of the present invention, the first engagement member can have a base region and an engagement region, wherein the surface of the base in contact with the guide rail has a concave curvature which is complementary to the curvature of the outer surface of the guide rail.

In one or more embodiments of the present invention, in a cross-sectional view an angle greater than 0° or equal to 0° can be disposed between the radius of the guide rail and the engagement plane. In one or more embodiments of the present invention, by engagement plane is meant the plane of the intended engagement of the first engagement member with the second engagement member; the plane is geometrically determined by a secant passing the centre at a defined distance therefrom and a vector of the direction of travel of the vehicle. Said angle corresponds to the angle between said secant and the radius, which intersects the secant at the circumference of the rail. In other words, the engagement direction of the toothing in the case of the toothing of the second engagement member (e.g., the drive gear of the vehicle) with the first engagement member does not occur radially to the rail, but laterally displaced. As a result of the variability of the angle, installation space can be saved. The radially engaging wheels thus obtain a maximum of clearance.

In one or more embodiments of the present invention, the opening extending through the base region of the first engagement member may be perpendicular or may extend perpendicularly to the surface of the rail, a fact which generally corresponds to the radial direction (e.g., in the case of a circular or elliptical cross-section of the rail).

In one or more embodiments of the present invention, the through-opening can be disposed such that it extends transversely to the direction of extension of the first engagement member and at an angle less than 90°, especially greater than 0° or equal to 0°, especially at an angle greater than 0°, especially at an angle greater than 5°, inclined relative to the engagement plane. In one or more embodiments of the present invention, by engagement plane is meant the plane of the intended engagement of the second engagement member with the first engagement member. As a rule, the second engagement member, which is configured, e.g., as a gear wheel, defines, e.g., through the position of the gear wheel, a plane in which the gear wheel lies and which defines the engagement plane. Since the second engagement member (e.g., gear wheel) is usually in direct engagement with the first engagement member, that is to say, lies in the region of a (predominant) plane of symmetry of the projections of the first engagement member, the plane of symmetry also lies in the engagement plane or determines it.

In one or more embodiments of the present invention, the rail can include at least one pipe having at least one opening into which the connecting member is inserted and in which it is attached.

In one or more embodiments of the present invention, the connecting member can be a screw.

In one or more embodiments of the present invention, the connecting member can also be a positive-locking connecting member.

In one or more embodiments of the present invention, further frictional- and/or positive-locking connecting members can be disposed for additional attachment.

In one or more embodiments of the present invention, in addition to the connecting members, especially a welded connection can be provided between the first engagement member and the rail.

In one or more embodiments of the present invention, the first engagement member can rest on the guide device in a statically determined manner. This means that it makes fixed contact at at least three points. In one or more embodiments of the present invention, the contact area of the first engagement member provided for contacting the pipe or on the rail is adapted to the geometry of the surface of the pipe or rail. Thus, already at the planning stage, provision can be made for adapting the underside of the base of the connecting member to the surface of the rail.

In one or more embodiments of the present invention, the connecting member can especially be inserted radially into an attachment component of the rail. The attachment components of the rail may, e.g., be threaded holes formed at those locations on the rail where the connecting members must be attached. Radial insertion generally means that the direction in which the connecting members are inserted at the rail is aligned perpendicular to the surface of the attachment surface of the rail.

In one or more embodiments of the present invention, the first engagement member can be attached to a surface of the rail, wherein the rail also provides a running surface for at least one wheel intended for guiding the vehicle. This means, e.g., that the rack is attached directly to the travel pipe (here corresponding to the rail), e.g., besides or at a predetermined distance from the running surface.

In one or more embodiments of the present invention, the first engagement member can be attached to an front/upper side of the rail, with the rear/bottom side and/or end face (side face) of the rail serving as a running surface for at least a wheel for guiding the vehicle.

In one or more embodiments of the present invention, the first engagement member can be a flexible engagement member, e.g., a chain or a cage rack with, e.g., members flexibly attached to each other.

In one or more embodiments of the present invention, the cross-section of the rail can be configured not only to be rotationally symmetrical, e.g., tubular, but can also have other cross-sections, e.g., in the form of a flat panel, to the underside of which the first engagement member, e.g., a chain, is attached. A running wheel runs on the top side and/or a side wheel runs on the side face of the rail.

In one or more embodiments of the present invention, the profile of the rail can be a double T-beam profile. In one or more embodiments of the present invention, the wheels engage with the upper flange of the profile. The rack or engagement chain is attached to the underside of the upper flange. Thus, the dimensional inaccuracies of and between the other parts of the support are not relevant.

DETAILED DESCRIPTION

The embodiment described below relates to a transport system, especially to a rail-bound passenger transport system in the private sector. The transport system can, however, be used in any other application for which it is suitable.

Figure 1:
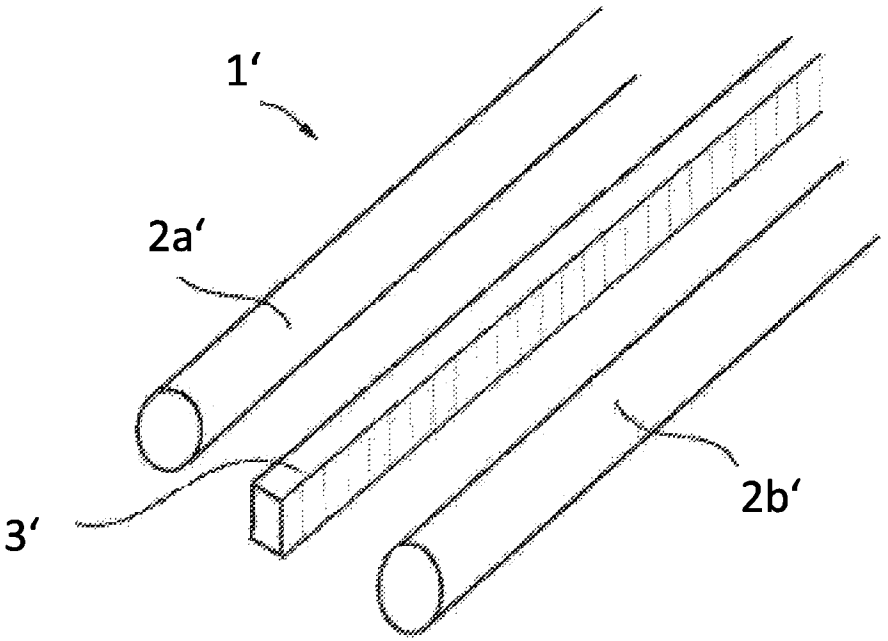
Fig. 1 Prior Art
FIG. 1 is a perspective view of prior art of a conventional guide system for a rail-bound transport system.

FIG. 1 shows a conventional guide system 1' comprising two parallel rails 2*a*' and 2*b*' for guiding dual track vehicles along a circuit as well as a rack 3' disposed centrally between the rails 2*a*', 2*b*'.

Figure 2:
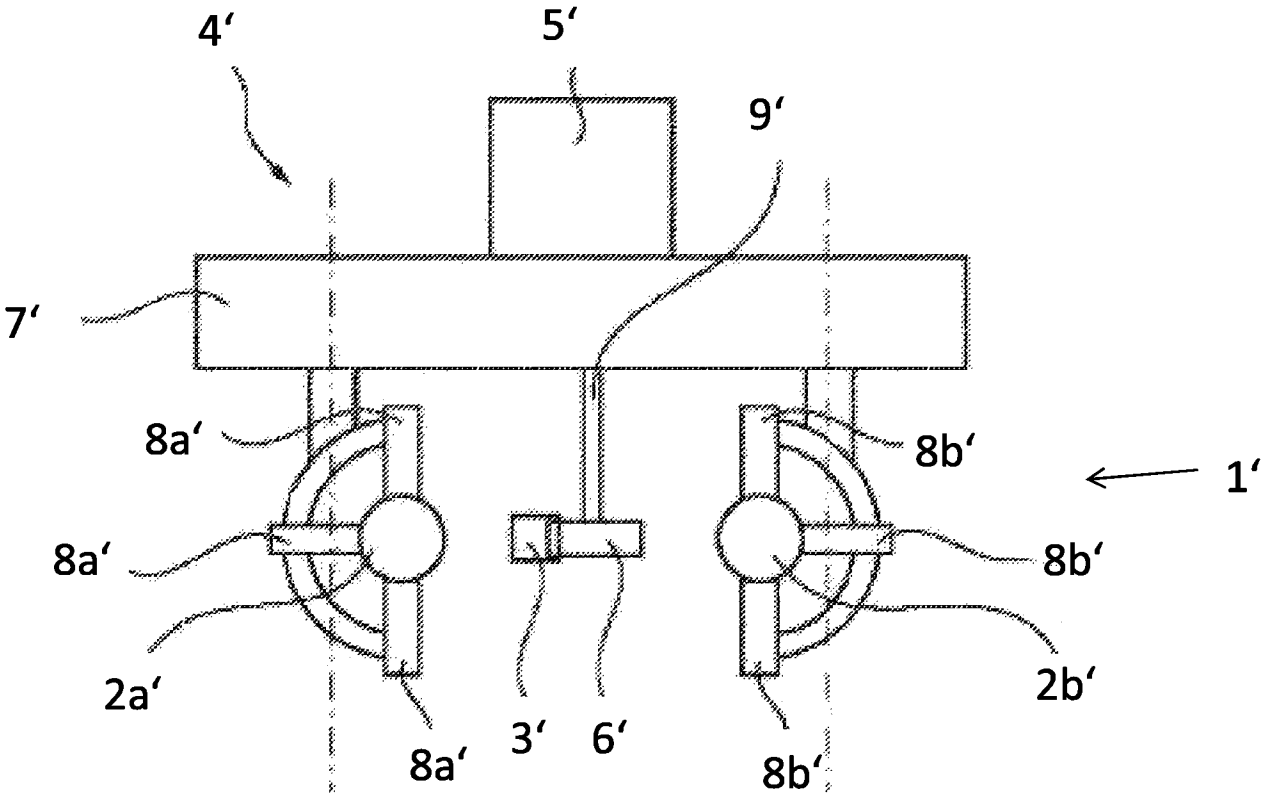
Fig. 2 Prior Art
FIG. 2 is a cross-sectional view of prior art of a conventional guide system with a vehicle.

As shown in FIG. 2, the rack 3' is intended for a positive drive 5', 9' 6' of a vehicle 4'. Here, a gear wheel 6' mounted to the vehicle 4' and drivable by way of a motor 5', engages with the rack 3'. The motor 5' is connected to the chassis 7' of the vehicle 4'. A shaft 9' transmits the power from the motor 5' to the gear wheel 6'. The chassis 7' is guided along the circuit via rollers 8*a*' 8*b*', which make contact with the rails 2*a*' and 2*b*'. The drive 5', 9' 6' can have a shaft and/or gear but can also be formed as a direct drive (e.g., hub motor) without shaft/gear, or just with gear and pinion, i.e., without shaft. The drive motor can be an electromagnetic or hydraulic drive or a combination thereof.

Figure 3:
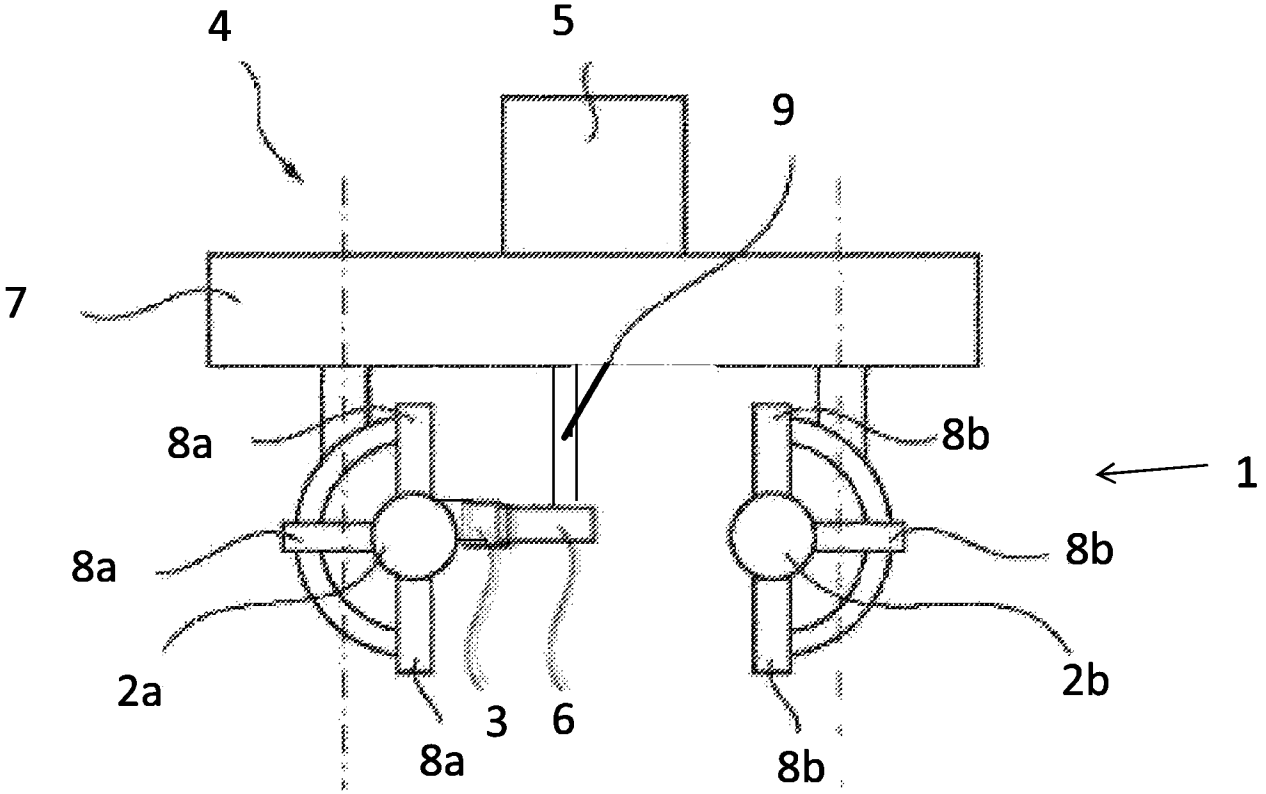
FIG. 3 is a side view of an embodiment of a rail-bound transport system according to the present invention.

FIG. 3 shows a side view of an inventive transport system. This has components similar to those in the system shown in FIGS. 1 and 2. Equivalent components, however, are labelled without an apostrophe.

The transport system comprises a circuit with a guide system 1 and a vehicle 4. The vehicle 4 is movable along the circuit and is connected thereto. A first engagement member 3, e.g., a rack, but especially a flexible engagement member such as a chain, is provided for positive drive of the vehicle 4. For this, a gear wheel 6 for positive drive which is mounted to the vehicle 4 and driven by way of a motor 5, engages with the engagement member 3. The motor 5 is connected to the chassis 7 of the vehicle 4. A shaft 8 transmits the power from the motor 5 to the gear wheel 6. The chassis 7 is guided along the circuit via rollers 8*a*, 8*b*, which make contact with the rails 2*a* and 2*b*. The drive can have a shaft and/or transmission but can also be formed as a direct drive (e.g., wheel hub motor) without shaft/transmission, or just with transmission and pinion, i.e., without shaft. The drive motor can be an electromagnetic or hydraulic drive or a combination thereof.

Figure 4:
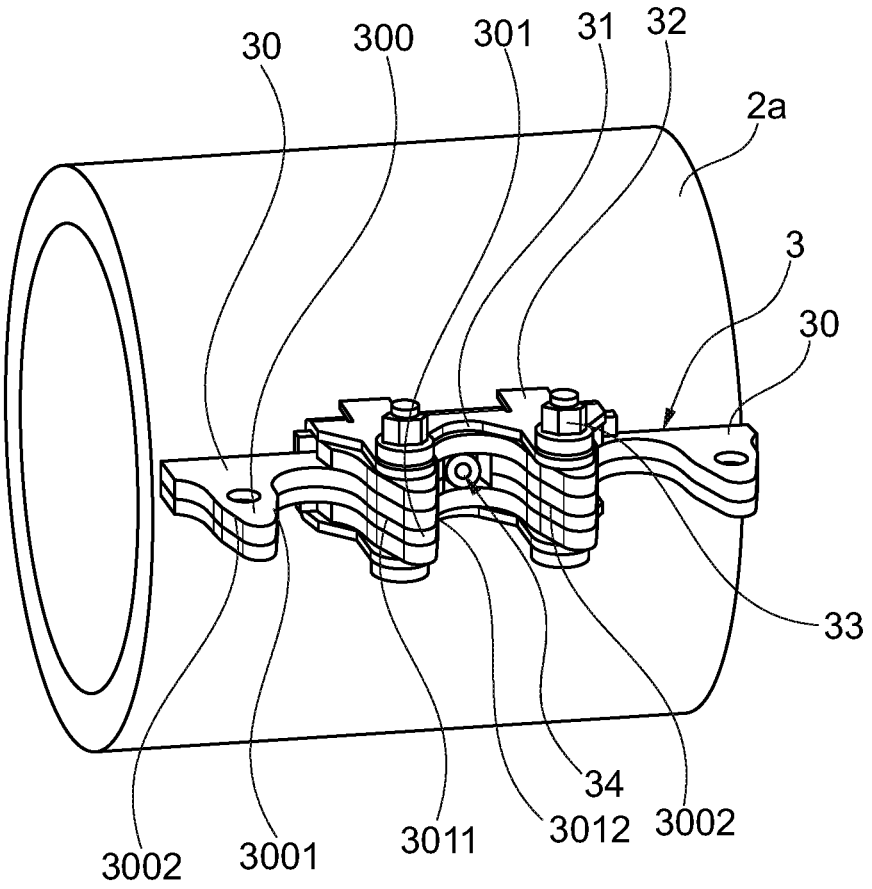
FIG. 4 is a perspective plan view of an embodiment of a section of a rail with an engagement member according to the present invention.

According to one or more embodiments of the present invention, the first engagement member 3 is attached to a rail 2*a*, in this case to a running rail or guide rail 2*a*. The type of attachment is, e.g., illustrated in detail in FIG. 4.

Figure 5:
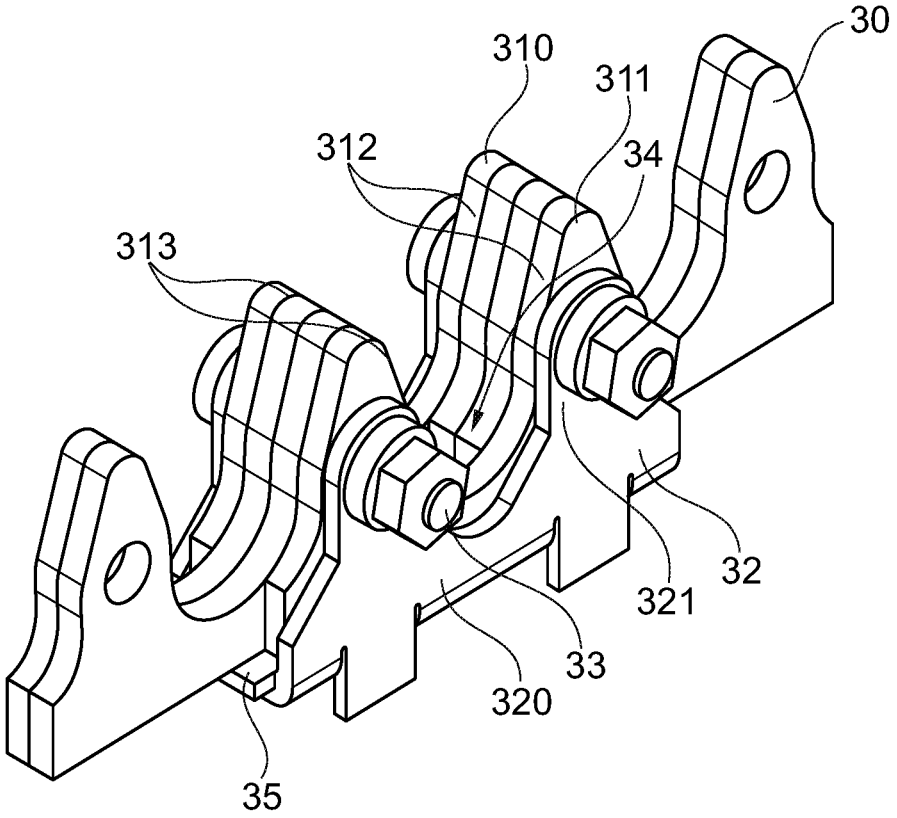
FIG. 5 is a perspective plan view of an embodiment of a section of an engagement member according to the present invention.

In this exemplary embodiment, the engagement member 3 is a chain comprising inner tooth segments 30 each having two teeth 300, 301 and two opposing inner tooth flanks 3001, 3011 and two outer tooth flanks 3002, 3012. Between each two inner tooth segments 30 is disposed an outer tooth segment 31 with two outer tooth components 310 and 311 encompassing the inner tooth segment 30 (see also FIG. 5). The outer tooth segment 31 is connected to a chain holder 32, via which the engagement member 3 is connected to the rail 2*a*. The opposing inner tooth flanks 3001 of each of the inner tooth segments 30 and their outer flanks 3012 and 3002 of two adjacent inner tooth segments 30 (together with the inner flanks 312 and 313 of the outer tooth segment 31 connected in each case) each form an engagement toothing for a complementary tooth of an engagement member on the vehicle side.

The chain holders 32 and the tooth segments 30, 31 are connected by way of shoulder screws 33. The chain holders 32 are attached to the rail 2*a* by way of a screw connection 34. The screw connection 34 enables variable and secure attachment, especially of relatively flexible engagement members 3 such as chains, even in the case of complex, curved and twisted circuit routes.

Figure 6:
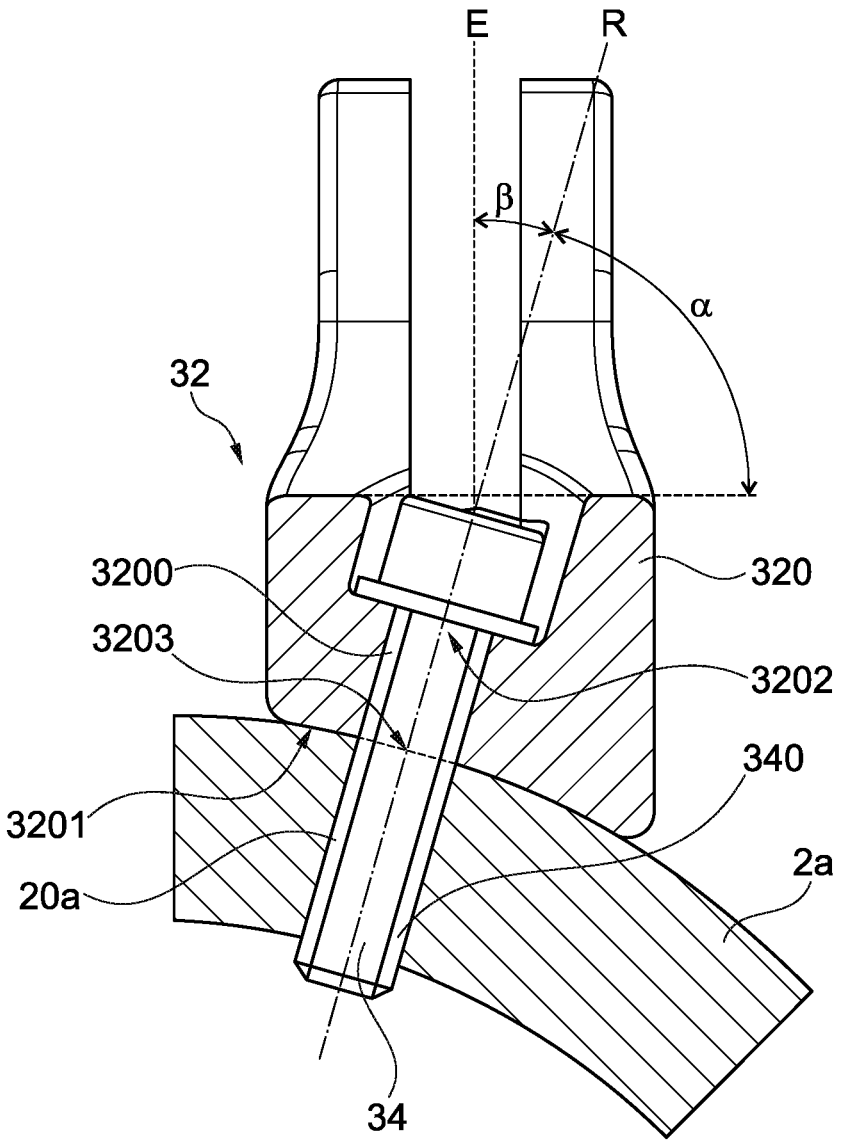
FIG. 6 a cross-sectional view of the embodiment of the engagement member from FIG. 4 according to the present invention.

FIG. 6 shows in more detail the structure of a chain holder 32 with toothed segments 30, 31 attached thereto. The chain holder 32 has a base region 320 with an opening 3200 (through-opening through the base region) for receiving the screw connection 34 and an engagement region 321 for receiving the shoulder screws 33. The engagement region 321 has a central groove corresponding roughly to the configuration of the outer tooth segments 310, 311. The opening cross-section 3202 of the through-opening 3200 accessible from the outside between the projections on the engagement side is disposed approximately centrally, midway between the lateral projections of the engagement region 321 in the base region 320. The opening also extends into a region between the two lateral tooth components 310 and 311 of the outer tooth segments 31 and two each of adjacent inner tooth segments 30. The engagement-side opening cross-section 3202 is disposed roughly in the engagement plane or intersects it. The rail-side opening cross-section 3203 is disposed at the opposite side of the base region.

A damping member 35 can be disposed between the chain holder 32 and the tooth segments 30, 31.

FIG. 6 shows the cross-section of the structure and the fastening of a chain holder 32 in detail. The base region 320 has a through-opening 3200 for a screw 34 (alternatively for a bolt). The cross-section of the underside 3201 of the base 320 is concavely curved such that the concave curvature is matched to the corresponding convex curvature of the rail 2*a*, i.e., the curvatures complement (convex/concave) one another.

The alignment of the engagement plane E of the engagement member 3 is not necessarily equal to a radial plane R which extends through the centre of the rail 2*a* or (alternatively or additionally thereto) is aligned perpendicularly to the surface of the rail 2*a* and which engages the engagement plane E in the surface of the rail. Instead, the planes E and R can form an angle θ which is, e.g., less than 90°, and/or greater than or equal to 0°, e.g., greater than 0°, greater than 5°, or greater than 10°, and/or smaller than 45°. The through-opening 3200, on the other hand, is aligned such that it runs radially to the centre point of the rail cross-sectional profile, or (alternatively or additionally thereto) is aligned perpendicularly to the surface of the rail 2*a*. Thus, the central axis of the through-hole forms an angle with the engagement plane, said angle corresponding to the angle θ between the engagement plane E and the radial plane R.

It goes without saying that the rail 2*a* has a bore 20*a* at a location corresponding to the through-opening 3200 into which the screw 34 can be guided. The screw has a thread 340 which may be screwed with an internal thread provided in the bore 20*a*.

Even in the case of winding routes (and combinations in three dimensions), it is possible to attach and adapt the chain to the routes. The chain attached at the (first) pipe is, in the event of a winding, i.e., lateral tilting of the vehicle, guided in such a way that its orientation relative to the second pipe at each circuit position of the drive section remains the same.

The alignment of the first engagement member relative to the plane defined by the two guide rails is thus always the same. In the event of a winding of the circuit between two circuit positions, e.g., the first engagement member describes a helical screw winding.

In one or more embodiments of the present invention, a transport system comprises a circuit with a guide system 1 and a vehicle 4. The vehicle 4 is movable along the circuit and is connected thereto. A first engagement member 3, e.g., a rack, but especially a flexible engagement member such as a chain, is provided for positive drive of the vehicle 4. According to the present invention, the first engagement member 3 is attached to one rail 2*a*, in this case to a running rail or guide rail 2*a*. Attachment is by way of a connecting member that engages through a through-opening of the engagement member 3.

The present invention may include one or more of the following concepts:

A. A transport system comprising:
- a vehicle (4);
- a circuit with a rail (2*a*, 2*b*) extending at least on sections of the circuit, the vehicle (4) being movably disposed along the circuit; and
- a drive system (3, 5, 6, 9) for a positive drive for propelling the vehicle (4) along the circuit, wherein, at least on sections extending along the circuit, the drive system has a first engagement member (3) and the drive system has a second engagement member (6), which is connected to the vehicle (4) and which is propellable,
- wherein the first engagement member (3) has projections (300, 301, 312, 313) on at least sections of the circuit and, between the projections, grooves, which are each bounded by a first projection (3002, 312) and an adjacent second projection (3012, 313),
- wherein the first engagement member (3) has openings (3200), of which at least one through-opening is formed between the first projection and the adjacent second projection, wherein through the opening engages a connecting member (34) for the purpose of connecting the first engagement member (3) with the rail (2*a*) for the purpose of attachment to the rail (2*a*).

B. The transport system in accordance with paragraph A, wherein the first engagement member (3) is attached to at least sections of the rail (2*a*) by way of positive-locking connecting members (34).

C. The transport system in accordance with paragraph A, wherein the first engagement member (3) is attached to at least sections of the rail (2*a*) by way of frictional-locking connecting members (34).

D. The transport system in accordance with paragraph A, wherein the cross-section of the rail (2*a*) is configured to have a convex outer surface.

E. The transport system in accordance with paragraph D, wherein the first engagement member (3) has at least one, especially a plurality of, element(s) (32) comprising a base region (320) and an engagement region (321), wherein the surface (3201) of the base region (320) in contact with the rail (2*a*) has a concave curvature which is complementary to the curvature of the outer surface of rail (2*a*).

F. The transport system in accordance with paragraph A, wherein in a cross-sectional view an angle greater than 0° or equal to 0° and less than 90° is disposed between a radial plane (R) of the rail (2*a*) and the engagement plane (E).

G. The transport system in accordance with paragraph A, wherein the rail (2*a*) comprises at least one pipe with a bore or hole into which the connecting member (34) is inserted.

H. The transport system in accordance with paragraph A, wherein the connecting member (34) is a screw.

I. The transport system in accordance with paragraph A, wherein the connecting member (34) is a positive-locking or frictional-locking connecting member.

J. The transport system in accordance with paragraph A, wherein further frictional-locking and/or positive-locking connecting members are disposed for additional attachment.

K. The transport system in accordance with paragraph A, wherein in addition to the connecting members, a welded connection is provided between the first engagement member (3) and the rail (2*a*).

L. The transport system in accordance with paragraph A, wherein the first engagement member (3) rests on the guide device in a statically determined manner.

M. The transport system in accordance with paragraph A, wherein the connecting member (34) is inserted radially into an attachment component (20*a*) of the rail (2*a*).

N. The transport system in accordance with paragraph A, wherein the first engagement member (3) is attached to a surface of the rail (2*a*), wherein the rail also serves as a running surface for at least one wheel (8*a*) intended for guiding the vehicle (4).

O. The transport system in accordance with paragraph A, wherein the first engagement member (3) is a flexible engagement member.

P. The transport system in accordance with paragraph A, wherein the first engagement member (3) is attached to a front/upper side of the rail (2*a*), wherein a rear/bottom side and/or at least one end face (side face) of the rail (2*a*) serves as a running surface for at least one wheel (8*a*) intended for guiding the vehicle (4).

The disclosure set forth above may encompass multiple distinct inventions with independent utility. Although each of these inventions has been disclosed in its preferred form(s), the specific embodiments thereof as disclosed and illustrated herein are not to be considered in a limiting sense, because numerous variations are possible. To the extent that section headings are used within this disclosure, such headings are for organizational purposes only. The subject matter of this disclosure includes all novel and nonobvious combinations and subcombinations of the various elements, features, functions, and/or properties disclosed herein. The claim concepts particularly point out certain combinations and subcombinations regarded as novel and nonobvious. Other combinations and subcombinations of features, functions, elements, and/or properties may be claimed in applications claiming priority from this or a related application. Such claims, whether directed to a different example or to the same example, and whether broader, narrower, equal, or different in scope to the original claims, also are regarded as included within the subject matter of the present disclosure. Furthermore, explicit reference is hereby made to all embodiments and examples shown in the drawings, whether or not described further herein.

What is claimed is:

1. A transport system comprising:

a vehicle;

a guide system for guiding the vehicle, the vehicle being movably disposed along the guide system;

a rail extending at least along at least one section of the guide system; and a drive system configured for a positive drive for propelling the vehicle along the guide system, wherein the drive system has a first engagement member attached to the rail, and the drive system has a second engagement member connected to the vehicle, the second engagement member being propellable, wherein the first engagement member has a first projection and an adjacent second projection, wherein between the first projection and the adjacent second projection at least one groove is provided, which is bounded by the first projection and the adjacent second projection, wherein the first engagement member has one or more openings, of which at least one through-opening is formed between the first projection and the adjacent second projection, further wherein through the through-opening engages a connecting member configured for connecting the first engagement member with the rail for attachment to the rail.

2. The transport system in accordance with claim 1, wherein the first engagement member is attached to at least sections of the rail by a positive-locking connecting member.

3. The transport system in accordance with claim 1, wherein the first engagement member is attached to at least sections of the rail by a frictional-locking connecting member.

4. The transport system in accordance with claim 1, herein a cross-section of the rail is configured to have a convex outer surface.

5. The transport system in accordance with claim 4, wherein the first engagement member has at least one or more elements, each element comprising respectively a base region and an engagement region, wherein a respective surface of the respective base region in contact with the rail has a concave curvature which is complementary to the curvature of an outer surface of the rail.

6. The transport system in accordance with claim 1, wherein in a cross-sectional view an angle greater than 0° or equal to 0° and less than 90° is disposed between a radial plane of the rail and an engagement plane.

7. The transport system in accordance with claim 1, wherein the rail comprises at least one pipe with a bore or hole into which the connecting member is inserted.

8. The transport system in accordance with claim 1, wherein the connecting member is a screw.

9. The transport system in accordance with claim 1, wherein the connecting member is a positive-locking connecting member.

10. The transport system in accordance with claim 1, wherein further positive-locking connecting members are disposed for additional attachment.

11. The transport system in accordance with claim 1, wherein in addition to the connecting members, a welded connection is provided between the first engagement member and the rail.

12. The transport system in accordance with claim 1, wherein the guide system comprises the rail and the first engagement member rests on the rail in a statically determined manner.

13. The transport system in accordance with claim 1, wherein the connecting member is inserted radially into an attachment component of the rail.

14. The transport system in accordance with claim 1, wherein the first engagement member is attached to a surface of the rail, wherein the rail also is configured to serve as a running surface for at least one wheel configured for guiding the vehicle.

15. The transport system in accordance with claim 1, wherein the first engagement member is a flexible engagement member.

16. The transport system in accordance with claim 1, wherein the first engagement member is attached to a front, upper side of the rail, wherein a rear, bottom side and/or at least one end face or side face of the rail is configured to serve as a running surface of the guide system configured for guiding at least one wheel of the vehicle.

17. The transport system in accordance with claim 1, wherein the connecting member is a frictional-locking connecting member.

18. The transport system in accordance with claim 1, wherein further frictional-locking connecting members are disposed for additional attachment.

19. The transport system in accordance with claim 1, wherein further frictional-locking and positive-locking connecting members are disposed for additional attachment.

* * * * *